United States Patent [19]

Saito

[11] Patent Number: 4,607,939

[45] Date of Patent: Aug. 26, 1986

[54] REMOVABLE DEVELOPING UNIT FOR AN ELECTROSTATIC RECORDING APPARATUS

[75] Inventor: Takeshi Saito, Ichikawa, Japan

[73] Assignee: Ricoh Company, Ltd., Japan

[21] Appl. No.: 653,932

[22] Filed: Sep. 24, 1984

[30] Foreign Application Priority Data

Sep. 22, 1983 [JP] Japan ..... 58-175763
Sep. 22, 1983 [JP] Japan ..... 58-175764

[51] Int. Cl.[4] ..... G03G 15/08

[52] U.S. Cl. ..... 355/3 DD; 355/3 R; 355/14 D

[58] Field of Search ..... 355/3 DD, 14 D, 3 R

[56] References Cited

U.S. PATENT DOCUMENTS 4,364,656 12/1982 Yanagawa ..... 355/3 R X
4,435,065 3/1984 Wada ..... 355/3 DD
4,478,512 10/1984 Zoltner ..... 355/3 DD
4,491,161 1/1985 Tamura et al. ..... 355/3 DD X

*Primary Examiner*—A. C. Prescott
*Attorney, Agent, or Firm*—Guy W. Shoup

[57] ABSTRACT

A removable developing unit of an electrostatic recording apparatus, particularly a multi-color copying apparatus, has a casing with an aperture, at one side to allow contact of a developing sleeve with a photoconductive member when the developing unit is mounted in the copying apparatus. A cover and an automatic closing mechanism is provided so that the aperture is covered when the developing unit is removed from the copying apparatus. The casing includes a toner hopper to which a replaceable toner cartridge is attached. The correct color of replacement toner for the developing unit is ensured by removable tabs or openings on the toner hopper which matches those of the correct color toner cartridge.

4 Claims, 7 Drawing Figures

REMOVABLE DEVELOPING UNIT FOR AN ELECTROSTATIC RECORDING APPARATUS

BACKGROUND OF THE INVENTION

This invention relates to developing devices each being removably mounted on the main body of each of electrostatic recording apparatus, such as electrophotographic copying apparatus, and more particularly it is concerned with a developing device of an electrostatic recording apparatus including a casing containing a toner which is selectively attached to the main body of the apparatus for performing recording in a desired color.

In recent years, electrostatic recording apparatus, such as electrophotographic copying apparatus, have become available which comprise a developing device removably mounted on the main body of the apparatus, and in which a plurality of developing devices each containing a toner of a different color, e.g. black, sepia and blue, are provided in reserve and a developing device of a desired color can be selectively mounted on the main body to obtain a duplicate image of a document in a desired color.

The developing device of the type described of the prior art includes a casing having a developing agent in powder form, such as a toner, sealed therein to avoid its scattering when mounted on the main body of the apparatus, and a developing sleeve adapted to come into contact with an electrostatic latent image carrier of the recording apparatus which is arranged such that a portion of its outer periphery is exposed to an opening of the casing. In the developing device of this construction, if a magnetic member, such as a paper clip or other foreign matter, such as dust, were deposited on the developing sleeve when the developing device is removed from the main body of the recording apparatus and if this developing device were mounted again on the main body of the recording apparatus to perform developing, the image of the copy of the document developed would be low in quality due to the presence of white streaks on the image or the developing device might suffer damage.

When the casing containing a toner is replenished, a toner cartridge is mounted on a toner hopper of the casing. If connections of the toner hopper and toner cartridge were of the same shape and dimensions for all the developing devices of toner of different colors, it would be possible to reduce production costs. However, this would give rise to the possibility that a toner cartridge of a color different from the color of the toner contained in the toner casing of the developing device might inadvertently be mounted on the toner hopper of the developing device. To avoid this possibility, it will be evident that if an opening and a projection were formed in the toner hopper of the developing device and the toner cartridge respectively and the toner cartridge were allowed to be mounted on the toner hopper only when the projection fitted in the recess just like a key is fitted in a keyhole, and the projection and the opening were varied in shape depending on the color of the toner, then it would be possible to accomplish the object of avoiding the possibility of inadvertently replenishing the casing with a toner of the wrong color. However, it would increase production costs to provide the toner cartridge and toner hopper with projections and openings of different shapes to signify differences in the color of the toner handled. Besides, an additional space would be required in the main body of the recording apparatus.

SUMMARY OF THE INVENTION

This invention has been developed for the purpose of obviating the aforesaid disadvantages of the prior art. Accordingly, the invention has as one of its objects the provision of a developing device capable of avoiding incorporation of foreign matter in the toner when the developing device is removed from the main body of the recording apparatus and stored alone for further use.

Another object is to provide a developing device in which the toner cartridge and the toner hopper are formed, by a simple construction, with a projection and an opening, respectively, having the relation of a key and a keyhole for a toner of the same color, readily and without requiring any additional space, thereby preventing a toner cartridge of wrong color from being inadvertently attached to the developing device.

The first object is accomplished according to the invention by providing the developing device with a cover for closing and opening an aperture formed in the casing for exposing a portion of the outer periphery of the developing sleeve. The developing device is further provided with an actuator normally urged to have its lower end move downwardly from the bottom surface of the casing to hold the cover in an open position through a transmission as the lower end moves downwardly and to hold same in a closed postion through the tranmission when the developing device is placed on a flat surface as the lower end of the actuator is forced to move upwardly. By forming the surface of the main body of the electrostatic recording apparatus in a shape that does not interfere with the downward movement of the actuator, it is possible to allow the aperture of the casing of the developing device to be automatically closed by the cover when the developing device is removed from the recording apparatus and placed on the desk or shelf and to enable the cover to be automatically moved to an open position, when the developing device is mounted on the recording apparatus, to allow the developing sleeve to be positioned against the electrostatic latent image carrier.

The second object can be accomplished according to the invention by forming a flange of the toner cartridge and a flange of the toner hopper, which are positioned against each other as the toner cartridge is mounted on the developing device. At one flange is a plurality of projections that can be readily destroyed and at the other flange are a plurality of openings located in positions corresponding to those of the projections so that the projections can be inserted in the respective openings to close same when they are not destroyed. By selecting one of the projections and the associated opening to form a combination for a toner of one color and destroying other projections on purpose to make it impossible for them to be inserted in the openings associated therewith, it is possible to readily form an engaging portion and an engaged portion related like a key and a keyhole for the toner cartridge and the toner hopper to indicate a toner of the desired color.

DETAILED DESCRIPTION OF THE PREFERRED EMBODIMENTS

Figure 1:
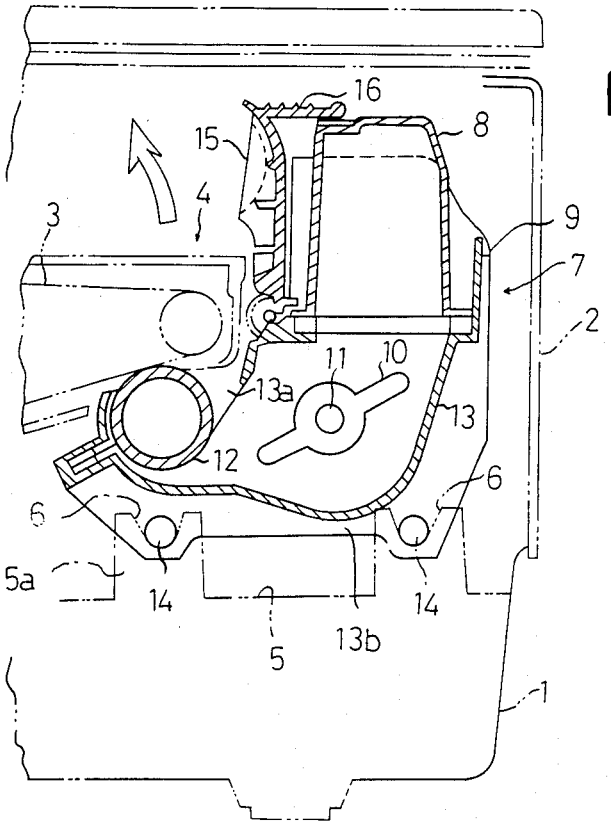
FIG. 1 is a sectional view of the developing device comprising one embodiment of the invention, shown as being mounted to a copying apparatus.

Referring to FIG. 1, a copying apparatus main body designated by the reference numeral 1 has a detachable side cover 2. A photosensitive member unit 4 including a photosensitive endless belt 3 serving as an electrostatic latent image carrier is supported in the copying apparatus main body 1 for pivotal movement in the direction of an arrow. Located beneath the photosensitive member unit 4 is a positioning member 5 for a developing device 7 which includes two stands 5*a* open at the top and each formed with a groove 6 extending widthwise of the developing device 7, the stands 5*a* being spaced apart from each other in the direction of travel of the photosensitive endless belt 3. The developing device 7 comprises a casing 13 substantially in the form of a letter L in cross section and formed at its upper portion with hopper 9 for receiving a toner cartridge 8. The casing 13 supports at its lower portion an agitator 10 for rotation on a rotary shaft 11 for agitating a toner stored therein, and a developing sleeve 12 for rotation which is located parallel to the rotary shaft 11. The casing 13 is formed at its lower portion with an aperture 13*a* so that an upper portion of an outer periphery of the developing sleeve 12 is exposed through the aperture 13*a* formed in the sleeve 13. Thus, when the developing device 7 is fitted to the copying apparatus main body 1 as shown in FIG. 1, the developing sleeve 12 is positioned against the photosensitive endless belt 3. The casing 13 is formed at its bottom with two ribs 13*b* spaced apart from each other lengthwise of the developing device 7 and extending along the width thereof, and positioning pins 14 spaced apart from each other in the direction of travel of the endless belt 3 are each secured to one of the ribs 13*b* and extend horizontally widthwise of the developing device 7.

A cover 15 is pivotably connected to a side edge of the aperture 13*a* of the casing 13 on the side of the hopper 9 for movement between an open position in which it leaves the aperture 13*a* open and a closed position in which it closes the aperture 13*a* to block communication therethrough. As shown in FIG. 1, the cover 15 is in its open position, and a projection 16 formed at a free end of the cover 15 is located in a position in which it forces the toner cartridge 8 downwardly from above.

The developing device 7 which is removably mounted to the copying apparatus main body 1 can be removed from the main body 1 and withdrawn therefrom by opening the side cover 2 and removing the positioning pins 14 from the grooves 4 of the positioning member 5 after the photosensitive member unit 4 is pivotally moved in the direction of the arrow and mounted to the main body 1 by inserting same in the main body 1 and placing the positioning pins 14 in the respective grooves.

The mechanism for opening and closing the cover 15 which is one of the features of the invention will now be described by referring to FIGS. 2 and 3. The cover 15 is secured to a support pin 19 connected to the side edge of the opening 13*a* of the casing 13 on the side of the hopper 9. An actuator 17 for moving the cover 15 between the open and closed positions includes a fork 20, a lever 21 and a connector 22 for resiliently connecting the fork 20 and lever 21 together. The fork 20 is formed to hold at its bifurcated lower end the positioning pin 14 located rearwardly of the length of the developing device 7 and bent substantially horizontally at its upper end to have a bolt 23 loosely fitted thereto. The lever 21 which is a strip of metal extending substantially vertically is bent substantially horizontally at its lower end to threadably receive the bolt 23 and formed at its upper end with a spherical joint 24 which is substantially integral therewith. The lever 21 is formed at its lower portion with a vertical slot 25 for loosely receiving a pin 26 formed at the casing. A tension coil spring 27 is mounted between the bent ends of the lever 21 and fork 20 in a manner to be wound around the belt 23. The joint 24 is force fitted in a recess complementary with the spherical surface of the joint 24 formed in a lower portion of a handle 28, so that the movement of the handle 28 can be transmitted to the lever 21 and the movement of the lever 21 can be transmitted to the handle 28. The handle 28 which is substantially in the form of a number 7 in cross section is formed with vertically extending guide slots 29 each of which receives therein one of guide pins 30 connected to the casing 13 for vertical movement.

Pivotably supported at an upper portion of the lever 21 through a pin 31 is a segmental gear 32 which is formed with teeth substantially on a quadrant and pivotably supported by the casing 13 through a pin 33 connected to the casing 13 at the center of its pivotal movement. A pin 34 is connected to a distal end of the segmental gear 32 and supports one end of a compression coil spring 35 which is supported at an opposite end by a pin 36 connected to the casing 13 in a position below that of the pin 34. Thus, the segmental gear 32 is moved clockwise about the pin 33 by the action of the spring 35, to move the lever 21 downwardly via the pin 31 to move the fork 20 via the bolt 23 downwardly below a bottom surface 37 of the casing 13. The handle 28 is normally urged to move downwardly through the joint 24. Meshing with the segmental gear 32 is an intermediate gear 38 which meshes with a pinion 39 secured to an end portion of the support pin 19. In the position in which the developing device 7 is mounted to the copying apparatus main body 1; the positioning pins 14 are located in the respective grooves 6; the pin 26 abuts against an upper edge of the slot 25; the pins 30 abut against upper edges of the guide slots 29 of the handle 28 or are located close to them; the cover 16 is in an upright position; and the projection 16 forces the toner cartridge 8 downwardly. At this time, the bolt 23 preferably has its head slightly spaced apart from the bent portion of the fork 20. Thus, the developing sleeve 12 is exposed through the aperture 13*a* of the casing 13 and positioned against the photosensitive endless belt 3, as shown in FIG. 1.

When it is desired to remove the developing device 7 from the copying apparatus main body 1, the side cover 2 shown in FIG. 1 is removed from the main body 1 and the photosensitive member unit 4 is pivotally moved in the direction of the arrow by suitable means, not shown. Then, the handle 28 is gripped by hand to lift the developing device 7 by removing the positioning pins 14 from the grooves 6. The developing device 7 in this condition is withdrawn from the main body 1 and placed on a horizontal surface 40, such as a desk top or a floor, as shown in FIG. 3. As the bottom surface 37 of the casing 17 is placed on the horizontal surface 40, the fork 20 depending from the bottom surface 37 is brought into contact with the horizontal surface at its lower end, and the fork 20 moves upwardly. More specifically, the bifurcation of the fork 20 is released from engagement with one of the positioning pins 13 and moves the lever 21 upwardly while stretching the spring 35. The upward movement of the lever 21 brings a lower edge of the slot 25 to a position close to the pin 26. After the lower edge of the slot 25 is brought into abutting engagement with the pin 26, the fork 20 still continues to move upwardly until the head of the bolt 23 is released from engagement with the upper bent portion of the fork 20. The upward movement of the lever 21 causes the segmental gear 32 through the pin 31 to move counterclockwise about the pin 33 in FIG. 1 against the biasing force of the spring 35. This causes the pinion 39 through the intermediate gear 38 to move counterclockwise in FIG. 1, so that the cover 15 is moved to the closed position in which it completely closes the aperture 13*a* of the casing 13.

Gripping the handle 28 by hand and lifting same causes the lever 21 to move upwardly through the joint 24 thus causes the cover 15 to move to the closed position. Therefore, if the handle 28 is gripped by hand and lifted when it is desired to remove the developing device 7 from the copying apparatus main body 1, then the cover 15 is automatically brought to the closed position in which it closes the aperture 13*a* of the casing 13. Conversely, if the hand is released frm the handle 28 after the positioning pins 14 are brought into engagement in the grooves 6 when the developing device 7 is mounted to the copying apparatus main body 1, then the segmental gear 38 is moved clockwise in FIG. 1 about the pin 33 by the biasing force of the spring 35, to thereby automatically move the cover 15 to the open position.

Cover opening and closing means generally designated by the reference numeral 18 is preferably covered with a cover, not shown, at all times.

Figure 4:
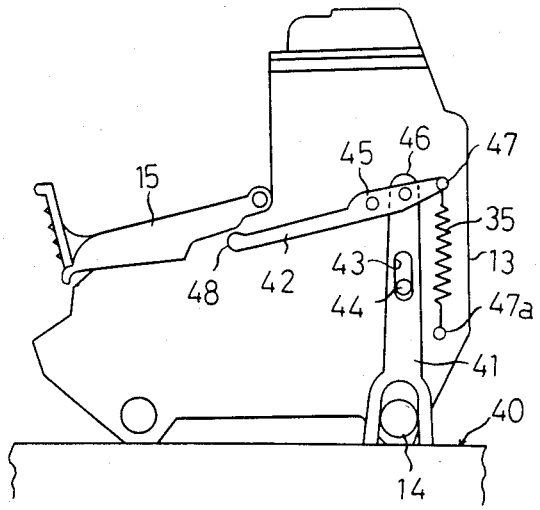
FIG. 4 is a side view of the developing device comprising another embodiment.

FIG. 4 shows another constructional form of developing device according to the invention in which a movable member 41 formed with a bifurcation at its lower end portion is a vertical lever engaging the positioning pin 14 by the bifurcation at all times. The movable member 41 is connected at its upper end portion to an arm 42 through a pin 46, and formed substantially at its central portion with a vertical slot 43 for loosely receiving therein a pin 44 secured to the casing 15. The arm 42 connected to the movable member 41 through the pin 46 is pivotably supported by the casing 13 through a pin 45, and a compression spring 35 is mounted between one end 47 of the arm 42 and a pin 47*a* secured to the casing 13. The pin 46 supporting the lever 41 is nearer to the one end 47 of the arm 42 than the pin 45 pivotally supporting the arm 42, and an opposite end 48 of the arm 42 can be brought into abutting engagement with a portion of the underside of the cover 15. Thus, when the developing device is removed from the copying apparatus main body and placed on the horizontal surface 40 as shown, the lower end of the lever 41 is brought into contact with the horizontal surface 40 and moves the lever 41 upwardly and causes the arm 42 to move counterclockwise in pivotal movement, so that the end portion 48 of the arm 42 is released from engagement with the underside of the cover 15 and the cover 15 is moved by its own weight to the closed position. Then, as the casing 13 is lifted, the lower end of the lever 41 is released from engagement with the horizontal surface 40 and the lever 41 is moved downwardly by the biasing force of the spring 35, so that the end portion 48 of the arm 42 pushes the cover 15 upwardly to the open position.

Figure 2:
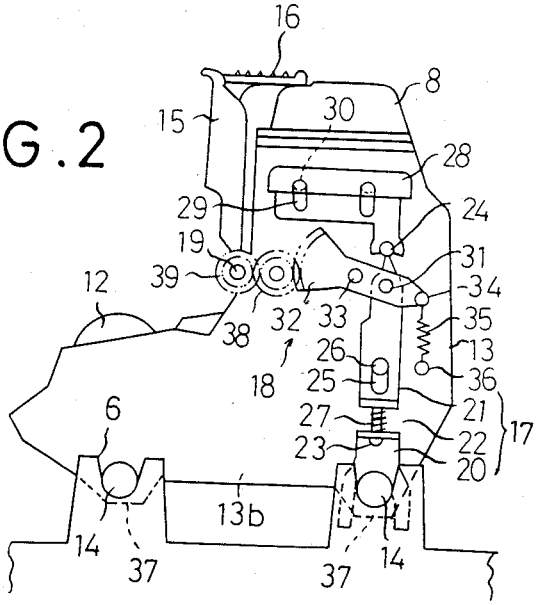
FIG. 2 is a side view of the developing device shown in FIG. 1.
Figure 3:
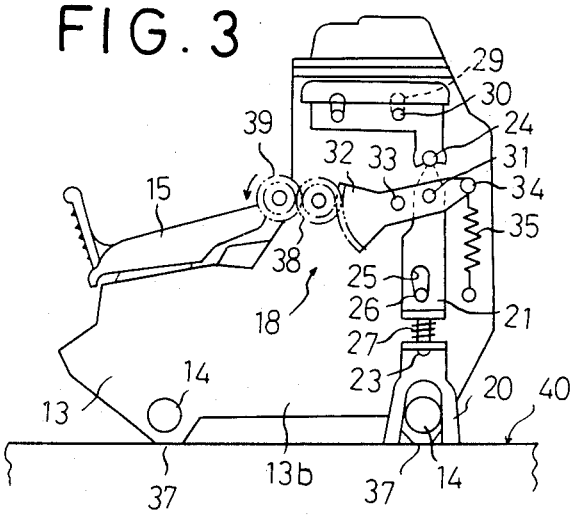
FIG. 3 is a side view of the developing device shown in FIGS. 1 and 2, shown as being placed on a flat surface after being removed from the copying apparatus.

In the constructional forms of the developing device shown in FIGS. 1–4, the constructional form shown in FIGS. 2 and 3 has a gearing as cover opening and closing means and the constructional form shown in FIG. 4 has a linkage as cover opening and closing means. The invention is not limited to these forms of cover opening and closing means, and a combination of a linkage and a gearing or a cam device may be used as cover opening and closing means.

Figure 5:
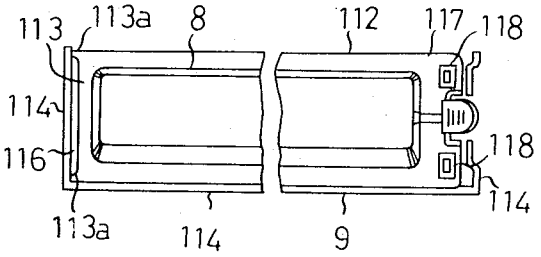
FIG. 5 is a top plan view of the toner hopper and toner cartridge of the embodiment shown in FIG. 1.
Figure 6:
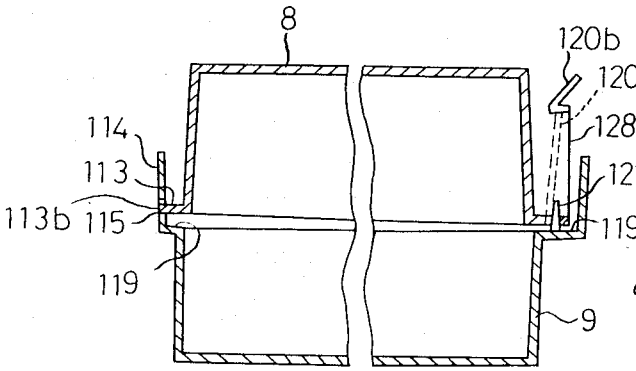
FIG. 6 is a sectional side view of the toner hopper and toner cartridge shown in FIG. 5.
Figure 7:
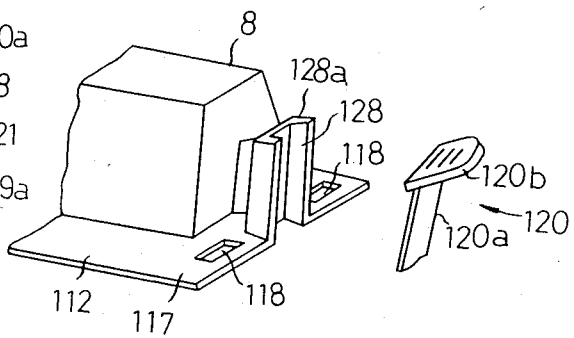
FIG. 7 is a perspective view of the toner cartridge, showing one end portion thereof.

FIGS. 5–7 show one example of the of an aperture at an upper portion of a toner hopper 9 and a portion of a toner cartridge 8 corresponding in position to the aperture of the toner hopper 9. As shown, the toner cartridge 8 which is open at its lower end while in use is frusto-pyramidal in shape in which the horizontal cross-sectional area becomes smaller in going upwardly and formed with a horizontally extending flange 112 at the peripheral edge of its lower portion. The flange 112 is formed at one lengthwise end 113 thereof with projections 113*a* located at opposite widthwise edges of the flange 112 and extending outwardly lengthwise thereof. (The lengthwise end 113 is located widthwise of the Photosensitive member.) The lengthwise projections 113*a* which are adapted to be received, as subsequently to be described, in openings 115 formed in a riser edge 114 of the toner hopper 9 define therebetween a space 116 which serves as a passage for a tab attached to a cover of the toner cartridge 8 to remove the cover. The flange 112 is formed in a central portion of an opposite lengthwise end 117 with a member 128 extending vertically and formed with a groove with its open end facing outwardly. An upper end 128*a* of the grooved member 128 extends upwardly outwardly in an inclined position. Two square openings 118 are formed at the end 117 of the flange 112 each on one side of the grooved member 128.

The toner hopper 9 is formed at a periphery of its upper opening with a horizontally extending flange 119, and an upright member 114 extending vertically upwardly from an outer edge of the flange 119. The flange 119 of the toner hopper 9 is adapted to be positioned against the flange 112 of the toner cartridge 8, and a flange 119*a* of the toner hopper 9 located on the side of the grooved member 128 of the toner cartridge 8 is formed at its upper end with a locking member 120 which extends upwardly. The locking member 120 which includes a strip portion 120*a* formed of resilient material, and a locking pin 120*b* formed integrally with each other is constructed such that the strip portion 120*a* is smaller in width than the groove of the grooved member 128 and the locking portion 120*b* is suitably sized and inclined to catch against an upper end 128*a* of the grooved member 128. The flange 119*a* of the toner hopper 9 has projections 121 secured thereto in positions corresponding to the positions of the square openings 118 formed at the end 117 of the flange 112 of the toner cartridge 8. Thus, as the toner cartridge 8 and the toner hopper 9 are assembled with each other, the projections 121 are received in the respective square openings 118 and the locking portion 120*b* of the locking member 120 engages the upper end 128*a* of the grooved member 128 in locking relation.

The engagement of the projections 121 in the respective square openings 118 will be described more in detail. Assume that the combination of the projections 121 and openings 118 is utilized for avoiding an inadvertent use of the toner cartridges of two different colors with one toner hopper of the two color developing device. Let the two openings be denoted by 118*a* and 118*b* and the two projections corresponding thereto be denoted by 121*a* and 121*b* respectively. If one projection were destroyed and corresponding opening were closed while the other projection were allowed to be inserted in the corresponding opening, the combination of the projections and openings would be as follows:

| | Combination | | | |
|---|---|---|---|---|
| Color | Projection 118a | Projection 118b | Opening 121a | Opening 121b |
| First Color (black, for example) | Intact | Destroyed | Open | Closed |
| Second Color (blue, for example) | Destroyed | Intact | Closed | Open |

In the table shown above, it will be seen that the toner cartridge of the second color (blue) cannot be used with the toner hopper of the first color (black), because the toner hopper of the first color has the projection 118*a* intact and the toner cartridge of the second color has the corresponding opening 121*a* closed. The projections 118*a* and 118*b* are formed integrally with the toner hopper 9 and one of them is selectively destroyed on purpose while leaving the other projection intact to provide the toner cartridge 8 and toner hopper 9 of a necessary combination. The toner cartridge 8 is usually formed of a synthetic resinous material, and it would not be necessary to form openings beforehand and a plurality of spots may be selected and each of them may be formed with a cut on each of three sides as is the case with the erasure preventing tab of a cassette for a magnetic recording tape to enable an opening to be formed by pushing the necessary spot with one end of a rod, for example. However, it would be more convenient to form two openings beforehand and close the unnecessary opening while leaving the necessary opening intact. In this embodiment, the toner hopper is formed of an ABS resin and has projections of a length of 15 mm and a diameter at the forward end of 1 mm and a diameter at the base of 2 mm. The toner cartridge is formed of a styrene resin and the openings are closed with a vinyl tape.

In the embodiment shown and described hereinabove, the invention has been described as being incorporated in a two color electrophotographic copying apparatus. However, the invention is not limited to this specific form of embodiment, and it can have application in a developing device of as many colors as is feasible.

The embodiment shown and described hereinabove is for the electrophotographic recording apparatus. However, it is to be understood that the invention can have application in an electrostatic printing press, facsimile system and other electrostatic recording apparatus.

From the foregoing description, it will be appreciated that according to the invention, the aperture of the casing through which the developing sleeve is exposed is closed by the cover when the developing device is withdrawn from the electrostatic recording apparatus in which it is mounted. Thus, when the developing device is removed from the electrostatic recording apparatus and stored for further use, the risk of foreign matter being incorporated in the developing agent is avoided and deterioration in the quality of the developing agent at the time of reuse is prevented. Additionally, the developing device placed on a flat surface when it is removed from the electrostatic recording apparatus is presentable in external appearance.

According to the invention, means is provided whereby the toner cartridge is brought into engagement with the toner hopper of the same color alone by a simple construction and a simple manual operation. This is conducive to avoidance of a toner cartridge and a toner hopper of different color being brought into engagement with each other, thereby preventing addition of toner of a wrong color at low cost.

What is claimed is:

1. A removable developing unit for an electrostatic recording apparatus comprising a casing having an aperture on one side, and a developing sleeve exposed in said aperture to be positioned against a photoconductive member when the developing unit is mounted in the recording apparatus, wherein the improvement comprises:

a cover pivotably mounted to said casing and movable to open and close said aperture; and automatic closing means in said casing for automatically closing said cover when said developing unit is removed from said recording apparatus.

2. A removable developing unit according to claim 1, wherein said automatic closing means includes a movable actuator projecting downwardly from an underside portion of said casing, means for biasing said actuator in a downward position, and a linkage connected between said actuator and said cover for closing said cover when said actuator is moved upwardly from said downward position and for opening said cover when said actuator is in said downward position, said recording apparatus having means for receiving said actuator projecting in said downward position when said developing unit is mounted therein, whereby said cover can be automatically closed when said developing unit is removed from said recording apparatus and placed with said underside portion of said casing on a flat surface so as to push said actuator upward.

3. A removable developing unit according to claim 2, further comprising a movable handle projecting externally of said casing to be gripped by an operator in order to lift the developing unit, said handle having a portion connected to said actuator so as to move said actuator upward when said handle is gripped and lifted, whereby said cover is kept closed when said developing unit is lifted and transported.

4. A removable developing unit according to claim 1, wherein said developing unit is adapted for a multicolor recording apparatus and further comprises a toner hopper having means including a flange for receiving a replaceable toner cartridge having a corresponding flange, one of the two flanges having a plurality of projections which can be selectively removed, and the other of the two flanges having a corresponding plurality of openings which can be selectively covered, whereby one projection of said one flange can be retained and the others removed, and a corresponding opening of said other flange can be left open and the others covered in order to ensure that only a toner cartridge of one desired color with a matching projection or opening can be placed on said toner hopper.

* * * * *